US005746281A

United States Patent [19]

Hulkkonen

[11] Patent Number: 5,746,281

[45] Date of Patent: May 5, 1998

[54] METHOD FOR MOUNTING HARD METAL BUTTONS IN A DRILL BIT

[75] Inventor: Teijo Hulkkonen, Kulju, Finland

[73] Assignee: Oy Robit Rocktools Ltd., Saaksjarvi, Finland

[21] Appl. No.: 557,181

[22] PCT Filed: Jun. 13, 1994

[86] PCT No.: PCT/FI94/00253

§ 371 Date: Dec. 13, 1995

§ 102(e) Date: Dec. 13, 1995

[87] PCT Pub. No.: WO94/29564

PCT Pub. Date: Dec. 22, 1994

[30] Foreign Application Priority Data

| | | | |
|---|---|---|---|
| Jun. 14, 1993 | [FI] | Finland | 932727 |
| Dec. 10, 1993 | [FI] | Finland | 935559 |

[51] Int. Cl.[6] ..... E21B 10/54

[52] U.S. Cl. ..... 175/420.1; 76/108.2; 175/374

[58] Field of Search ..... 175/420.1, 374, 175/432, 433, 435, 375, 426; 76/108.2

[56] References Cited

U.S. PATENT DOCUMENTS

| | | | |
|---|---|---|---|
| 2,707,619 | 5/1955 | Andersson . | |
| 2,750,156 | 6/1956 | Coates . | |
| 3,294,186 | 12/1966 | Buell . | |
| 3,600,795 | 8/1971 | Brundlin et al. . | |
| 4,350,215 | 9/1982 | Radtke . | |
| 4,453,775 | 6/1984 | Clemmow | 175/393 X |
| 4,570,725 | 2/1986 | Matthias et al. . | |
| 4,676,124 | 6/1987 | Fischer . | |
| 4,744,270 | 5/1988 | Vezirian | 76/108.2 |
| 4,867,015 | 9/1989 | Kane et al. . | |
| 4,873,895 | 10/1989 | Taylor et al. | 76/108.2 |
| 4,951,762 | 8/1990 | Lundell | 76/108.2 X |
| 5,172,780 | 12/1992 | Batliner et al. . | |

FOREIGN PATENT DOCUMENTS

| | | | |
|---|---|---|---|
| 0351039 | 1/1990 | European Pat. Off. | 175/331 |
| 964/64 | 6/1969 | Finland . | |
| 780 154 | 2/1985 | Finland . | |
| 893574 | 6/1990 | Finland . | |
| 664 983 | 1/1952 | United Kingdom . | |
| 1 276 331 | 6/1972 | United Kingdom . | |
| 2 099 044 | 4/1981 | United Kingdom . | |
| 2 136 035 | 9/1984 | United Kingdom . | |
| 92/11437 | 7/1992 | WIPO . | |

*Primary Examiner*—Hoang C. Dang
*Attorney, Agent, or Firm*—Ladas & Parry

[57] ABSTRACT

A method for mounting hard metal buttons in a drill bit and a drill bit. In the method, a hole (4) is worked into a drill (1) before the drill bit is tempered. Subsequently, a hard metal button (3*a*) surrounded by brazing material is positioned into the hole (4) of the drill bit (1). The assembly is positioned into a tempering space, in which the brazing material spreads around the hard metal button (3*a*) into a space between the walls of the hole (4) and the hard metal button (3*a*) under the influence of heat. When the drill bit (1) is cooled after this, the brazing material (5) solidifies, and simultaneously, the body portion (2) of the drill bit (1) having a higher thermal expansion coefficient presses the hard metal button (3*a*) through the brazing material (5).

9 Claims, 2 Drawing Sheets

METHOD FOR MOUNTING HARD METAL BUTTONS IN A DRILL BIT

Figure 1A:
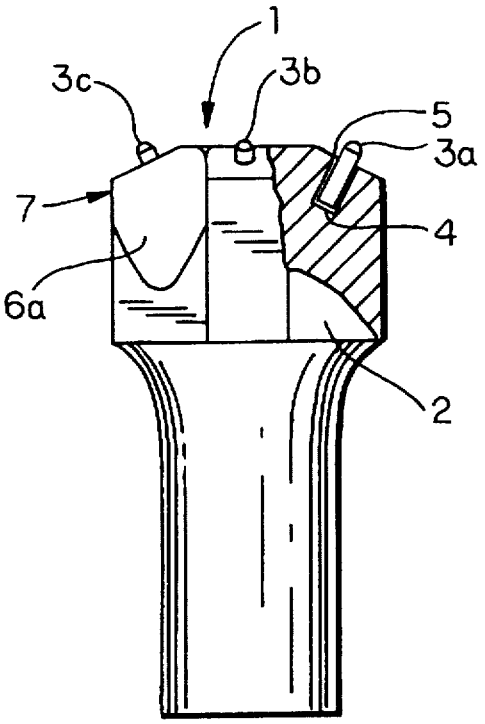

The invention relates to a method for mounting hard metal buttons in a drill bit, in which the substantially cylindrical hard metal buttons are mounted by means of compression connection in holes formed in a drill bit body portion to be tempered at a high temperature, the holes having a substantially round cross-section and being formed before the tempering of the body portion.

The invention relates further to a drill bit, comprising a drill bit body portion to be tempered at a high temperature, holes formed in the body portion and having a substantially round cross-section and substantially cylindrical hard metal buttons to be mounted in the holes by means of compression connection, the holes for the hard metal buttons being formed in the body portion before the tempering of the body portion.

A traditional problem with rock drill bits has been durability. At drilling, a rock drill bit becomes dull rather quickly, which decreases the drilling capacity. Attempts have been made to solve the problem by attaching various point portions manufactured of a very hard material to the point of a drill rod. For attaching a point portion directly to a drill rod, the hard metal portion has to be connected to the drill rod by brazing or some other similar method. To drill rods is generally connected a so-called drill bit, which can be attached by means of a threading or in some other corresponding manner. The hard metal portions required by the drill bit may then be jointed separately to the bit, due to which it is not necessary to change the whole drill rod when the drill bit wears or breaks, but it is enough to replace the drill bit only.

British Patent Applications 2 136 035 and 2 099 044 as well as U.S. Pat. Nos. 4,570,725 and 4,350,215 disclose various drill bits intended for rotary bits, to which are jointed hard metal buttons by brazing to facilitate drilling. However, since these drill bits are not used for percussion drilling, hard metal buttons can be mounted in them in a considerably easier manner than in drill bits intended for percussion drilling. Rotary bits drill into a material to be worked by scraping the bottom material of a hole in the first place, due to which the material to be drilled is not subjected to a percussive force of any kind. Accordingly, the drill bits and the mountings of hard metal buttons thereto disclosed by said publications differ entirely from the drill bits intended for percussion drilling.

Finnish Patent Application 964/64 discloses a drill bit intended for percussion drilling, in which a hard metal point portion is jointed by brazing to an opening formed in the point of a drill rod and having substantially the form of the hard metal point, whereby the hard metal point aligns with the mid-line of the drill rod. The use of this solution proved to be economically more expensive when hard metal button bits were introduced to the market. Further, it shall be taken into account that it is not possible to change a separate drill bit to this drill rod, but the whole drill rod has to be replaced when the hard metal portion wears.

Finnish Patent Application 780 154 describes a rock working tool and an insert mounted therein by brazing. The insert is mounted only by brazing in said rock working tool and the invention of the publication relates only to a centering of the insert in the point of the rock working tool. The problems of the rock working tool are thus the same ones as set forth in connection with the previous application.

Finnish publication 893 574 describes a drill bit provided with hard metal bit portions, in which separate support plates guide a hard metal point into a groove made in the point of the drill bit, which plates are then, together with the hard metal bit, brazed into the point of the drill bit to achieve a uniform assembly. Furthermore, it is a very cumbersome and time-consuming working process to mount a hard metal bit in a drill bit by means of various support plates. Also this solution is economically inferior to the button bit used at present.

U.S. Pat. No. 2,707,619 discloses a hard metal bit positioned in a groove made in the point of a rock working tool. The hard metal bit itself, its sides, are provided with projections, which are due to be supported against the walls of the groove in the rock working tool. Correspondingly, brazing material is placed in an opening between the wall of the groove in the rock working tool and the wall of the hard metal bit for mounting the hard metal bit in the rock working tool. Said working tool has similar problems as set forth above.

U.S. Pat. No. 2,750,156 describes a drilling tool, in which hard metal portions are jointed to a drill bit by brazing, whereby the joint is provided only by a bonding created by brazing material between the hard metal bit and the drill bit. The problems are still similar to those described above.

U.S. Pat. No. 3,294,186 discloses a drill bit, in which a hard metal bit is mounted in a slot or an opening made in the bit, the slot or opening being substantially bigger than the hard metal bit. Shims coated by a braze metal are positioned between the hard metal bit and the drill bit. After shimming, the drill bit is heated, whereby the braze metal melts and brazes the shims and the hard metal bits to the drill bit. Problems are still caused by various stresses created in the drill bit through the heating and by a complicated and difficult manufacture.

British Patent 664 983 describes an improved rock working tool, in which a hard metal percussion bit is placed in a brazing material pocket having substantially the form of the bit, and subsequently, the hard metal bit together with its brazing material pocket is positioned in a groove in the point of the rock working tool. Then the whole is heated so that the brazing material melts and brazes the hard metal bit and the rock working tool together. The problems are as above. The hard metal bit is fastened only by brazing and stress states of various kinds arise in the tool because of temperature differences.

It shall be noted that the hard metal portions of the percussion rock working tools or rock drills described above are mounted in a rock working tool or a rock drill mainly by brazing, and therefore, the durability of the joint is based on the brazing only, for which reason a very high accuracy and carefulness are required of the manufacturing process. For economical and practical reasons, drill rods provided with hard metal bit portions have in general been replaced by hard metal button bits, the manufacture of which is, however, associated with accuracy and cost problems. When the present processing and manufacturing methods are used, the accuracy of manufacturing a button bit is very high and even small errors or tolerance variations in the manufacture lead to loose or broken buttons, which again increases the operating costs.

The object of the present invention is to eliminate drawbacks mentioned above and to make it possible to mount a hard metal button in a rock working tool or a drill bit even by means of compression connection.

The method of the invention is characterized in that the thermal expansion coefficient of the body portion of the drill bit is higher than the thermal expansion coefficient of a hard metal button and that the hard metal button is positioned in a hole before the tempering of the drill bit, the button moving freely in the hole at the tempering temperature, and brazing material molten at the tempering temperature is placed in the hole or around the hard metal button outside the body portion in such a way that, at the tempering of the body portion of the drill bit, the brazing material fills a space between the walls of the hole and the hard metal button, the space being caused by the different thermal expansion, and that the brazing material solidifies and forms a shell between the hard metal button and the walls of the hole, when the drill bit is cooling, due to which, when the drill bit is cooling further, the hole shrinks more than the hard metal button so that the body of the drill bit provides at the operating temperature a compressive force in the hard metal button through the brazing material.

The drill bit according to the invention is further characterized in that the thermal expansion coefficient of the body portion of the drill bit is higher than the thermal expansion coefficient of a hard metal button and that a hole and a hard metal button are dimensioned in such a way that a space between the walls of the hole and the hard metal button, the space being caused by the different thermal expansion, is filled by brazing material molten at the tempering temperature and placed in the hole or around the hard metal button outside the body portion, whereby the brazing material has solidified and formed a shell between the hard metal button and the walls of the hole, when the drill bit is cooled, and when the drill bit is cooled further, the hole has shrunk more than the hard metal button so that there is a compressive force, active through the brazing material, between the body of the drill bit and the hard metal button.

An essential idea of the invention is that the brazing and tempering of a hard metal button and a drill bit occur simultaneously, due to which no different tempering zone interface remains on the drill bit because of the heating occurring at different times. A further essential idea is that the hard metal button of a final product is cylindrical, and therefore, easy to work into shape. Correspondingly, holes having a diameter substantially equal to the diameter of a hard metal button are worked into an untempered drill bit, which means that the hard metal button may have close fit with respect to the diameter of the hole when being positioned into the hole. The hard metal button is mounted in the hole by means of brazing material in such a way that the brazing material fills a space between the body portion of the drill bit and the walls of the hard metal button at the tempering. When the drill bit and the hard metal button are cooling, the brazing material solidifies around the hard metal button in the space between the hole walls and the hard metal button and mounts the hard metal button in the hole in the drill bit. When the drill bit is cooling further, the hole in the drill bit shrinks more than the hard metal button due to the different thermal expansion coefficients of the materials, whereby the metal of the drill bit presses the hard metal button through the solidified brazing material, due to which the hard metal button is attached to the drill bit both under the influence of the brazing material and the compressive force caused by the metal of the drill bit. Accordingly, the mounting of the hard metal button occurs at the same time as the tempering. According to one embodiment, brazing material is placed at the bottom of a hole before a hard metal portion is positioned into the hole of the drill bit. Subsequently, the drill bit together with the hard metal portion is tempered in such a way that the assembly is positioned into the space where the tempering takes place, whereby the brazing material in the hole melts when heated and spreads by capillary action into the space between the hard metal portion and the walls of the hole in the drill bit. According to another advantageous embodiment, brazing material is placed around a hard metal button outside the body portion of a drill bit, whereby the brazing material melts around the hard metal button, when the drill bit is heated to the tempering temperature, and fills the space between the body portion of the drill bit and the walls of the hard metal portion. According to still another embodiment, annular brazing rings manufactured of brazing material and broken at one point of the periphery can be used, in which case the diameter of a brazing material ring can be increased, if necessary, up to the diameter of the hard metal button or the diameter of the brazing ring can be decreased in some situation, respectively. According to one advantageous embodiment, the upper edge of the hole can be provided with a groove for brazing material, which ensures that the brazing material remains at the right place during different stages of operation.

One of the essential advantages of the invention is that a hole to be drilled into a drill bit does not need to be made with a very high accuracy, but it may deviate rather much from the theoretical form. Furthermore, it is very advantageous to drill a hole into an untempered material and no special bits are required of the working tool therefor. Likewise, the hole surface may be considerably rougher than in case if holes are drilled into an already tempered body, because the effect of surface roughness on a hard metal button can be eliminated by means of this method. Another advantage is that the brazing material equalizes the unevennesses both in the hole of the drill bit and on the hard metal button, respectively. Accordingly, an even compression is effected in the area of the entire hard metal button, which decreases the risk of damage of the hard metal button considerably. Additionally, the use of brazing material in the manner according to the method prevents the button from loosening considerably better than before and also allows a use of hard metal buttons considerably shorter than those used by the prior art technique, through which both material and manufacturing costs are saved.

Figure 1B:
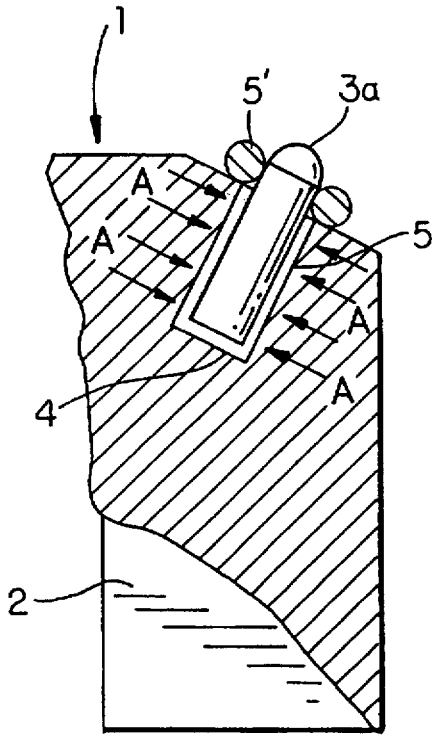
Figure 1C:
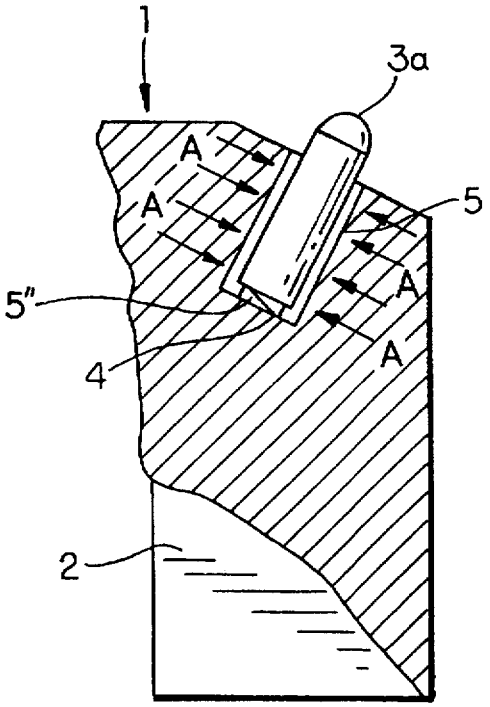
Figure 2A:
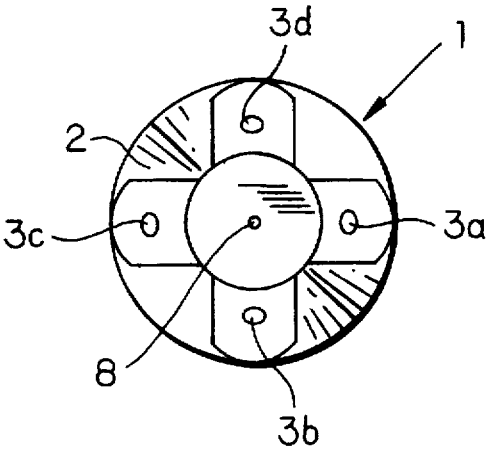
Figure 2B:
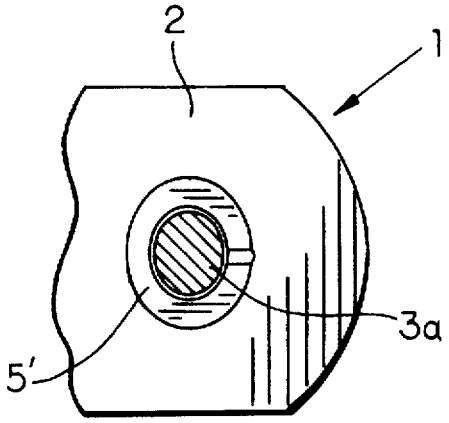
Figure 3:
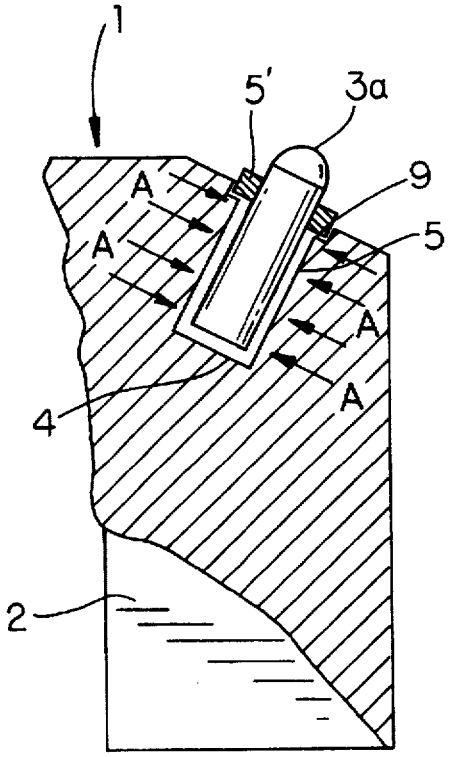

The invention will be described in more detail in the following drawings, in which FIG. 1*a* shows a side view of a mounting in a drill bit according to the invention in partial cross-section, FIG. 1*b* shows the cross-sectional area of FIG. 1*a* according to one embodiment enlarged, FIG. 1*c* shows the cross-sectional area of FIG. 1*a* according to another embodiment enlarged, FIG. 2*a* shows the mounting according to the invention from the end of the drill bit, FIG. 2*b* shows a positioning of a brazing ring around a hard metal button in the manner according to FIG. 1*b* and FIG. 3 shows the cross-sectional area of FIG. 1*a* according to a third embodiment enlarged.

FIG. 1*a* shows a drill bit 1, comprising a body portion 2 and hard metal buttons 3*a*, 3*b* and 3*c* attached thereto. A cross-sectional part in FIG. 1*a* shows a hole 4 worked into the drill bit 1 for mounting a hard metal button 3*a*. A slot between the hard metal button 3*a* and the walls of the hole 4 in the body portion 2 of the drill bit 1 is filled with brazing material 5. Correspondingly, recesses are worked into the body portion 2 of the drill bit 1, FIG. 1*a* showing a recess 6*a* for removing drillings, loosened from the rock, from the surface to be drilled and for cooling a point portion 7 of the drill bit 1.

FIG. 1*b* shows the cross-sectional area of FIG. 1*a* enlarged, illustrating the mounting of the hard metal button 3a in the body portion 2 of the drill bit 1 perspicuously. FIG. 1b shows further a positioning of a brazing material ring 5' around the hard metal button 3a outside the body portion 2 of the drill bit 1 before the drill bit 1 is tempered. The reference numerals of FIG. 1b correspond to those of FIG. 1a. When the drill bit 1 is tempered, the brazing material ring 5' melts and forms a shell in a space between the walls of the hard metal button 3a and the walls of the hole 4 in the drill bit 1. The shell formed by the brazing material in the space between the walls of the hole 4 in the drill bit 1 and the walls of the hard metal button 3a is indicated by the numeral 5. The hole 4 may vary from its theoretical form rather much. Correspondingly, the circularity of the cross-section of the hard metal button 3a may also vary from its theoretical form. The drill bit 1 is positioned into the space where the tempering is performed by heating the assembly comprising the body portion 2 of the drill bit 1, the brazing material ring 5' and the hard metal button 3a, respectively. When the drill bit 1 is heated to a temperature at which the brazing material ring 5' melts, the material begins to spread by capillary action from the surface of the body portion 2 of the drill bit 1 into the space between the hard metal button 3a and the walls of the hole 4 in the drill bit 1, the hard metal button 3a moving freely in the hole 4, when the material of the drill bit 1 is at the tempering temperature of e.g. 600° to 1000° C. Then a shell formed by the brazing material 5 surrounds the hard metal button 3a. At the cooling of the drill bit 1, respectively, the material of the body portion 2 of the drill bit 1 shrinks considerably more quickly than the material of the hard metal button 3a, due to which, when the brazing material 5 is solidifying, the space between the walls of the hole 4 in the drill bit 1 and the walls of the hard metal button 3a is subjected to a compressive force from the material of the body portion 2 of the drill bit 1 towards the hard metal button 3a in the manner indicated by arrows A. Then the compressive force from the material of the body portion 2 of the drill bit 1 is transmitted by means of the brazing material 5 to the surface of the hard metal button 3a thus constituting a compression connection between the body portion 2 and the hard metal button 3a. The compressive fit of the substantially cylindrical hard metal button 3a in the hole in the body portion results essentially only from the above cooling of the hard metal button, brazing material and the body portion.

FIG. 1c shows the same area as FIG. 1b. The reference numerals of FIG. 1c correspond to those of the FIGS. 1a and 1b. The hard metal button 3a is surrounded by the brazing material 5 placed at the tempering in the space between the walls of the hole 4 and the hard metal button 3a, respectively. Before the drill bit 1 is tempered, a piece 5" of brazing material is placed at the bottom of the drilled hole 4. Subsequently, the hard metal button 3a, which may even have close fit, is positioned into the hole 4 in the body portion 2 of the drill bit 1. The drill bit 1 is positioned into the space where the tempering is performed by heating the assembly comprising the body portion 2 of the drill bit 1, the piece 5" of brazing material and the hard metal button 3a, respectively. When the drill bit 1 is heated to a temperature at which the brazing material 5 melts, the material begins to spread by capillary action into the space between the hard metal button 3a and the walls of the hole 4 in the drill bit 1, due to which the hard metal button 3a moves freely in the hole 4 when the material of the drill bit 1 is at the tempering temperature. Then the hard metal button 3a is surrounded by the brazing material 5 and a compression connection is provided between the body portion 2 and the hard metal button 3a in the manner described above.

FIG. 2a shows a drill bit according to the invention from the end of the drill bit 1, in which hard metal buttons 3a, 3b, 3c and 3d are positioned within the same radius from the mid-line of the drill bit. Nevertheless, it shall be noted that the positioning may occur in any form, due to which the distance of each hard metal button from the mid-line of the drill bit may vary depending on the size of the drill bit. FIG. 2 shows further a flushing hole 8 for the drill bit, by which hole flushing medium, like air or water, can be passed through the drill bit 1.

FIG. 2b shows a brazing material ring 5' positioned around a hard metal button 3a outside the body portion 2 of a drill bit 1. In the simplest manner, the hard metal button 3a may be coated with brazing material and not until then hit into the hole in the body portion 2 of the drill bit 1, whereby substantially all brazing material remains on the surface of the body portion 2. The edge of the hole collects the brazing material located outside the outer dimension thereof on the surface of the body portion 2 and forms a brazing material ring. Correspondingly, it is also possible to use a ring which is placed around the hard metal button 3a only after the hard metal button 3a has been positioned into the hole 4 in the body portion 2. Moreover, the brazing material ring 5' may be a ring broken at its periphery, as shown in FIG. 2b, in which case its diameter may change to a desired extent when it is placed around the hard metal button 3a. Subsequently, when the drill bit 1 is heated to the tempering temperature, the brazing material ring 5' melts and spreads from the surface of the body portion 2 into the space between the walls of the hole 4 in the body portion 2 and the walls of the hard metal button 3a and forms a brazing material shell 5 around the hard metal button 3a.

FIG. 3 shows a positioning of a brazing material ring 5' into a brazing groove 9 to be made at the upper edge of a hole 4. By means of the brazing groove 9, the brazing material ring 5' can be made to remain at the right place during the different stages of operation. Furthermore, the brazing material ring 5' may be forced into the brazing groove, as shown in FIG. 3, which makes the remaining in place more secure than before.

The figures and the associated description are only intended to illustrate the idea of the invention. As to the details, the invention may vary within the scope of the claims. So, it is possible, for instance, to make the hole 4 in such a way that the diameter of the hole 4 is substantially larger than the diameter of the hard metal button 3a, which makes the hole 4 wide with respect to the hard metal button 3a. Accordingly, the compression connection is provided by means of the brazing material 5 spreading evenly into the space between the walls of the hole 4 and the hard metal button 3a. Then the material of the body portion 2 of the drill bit 1 presses the hard metal button 3a evenly. Furthermore, the number of hard metal buttons is not in any way connected with the above, and therefore, their number can vary depending on the size of the body portion 2 of the drill bit 1.

I claim:

1. A method for mounting a substantially cylindrical hard metal button in a drill bit by a compression fit, comprising the steps of:

positioning said substantially cylindrical hard metal button in a hole in a body portion of the drill bit, said hole having a substantially round cross-section and said body the drill bit having a thermal expansion coefficient greater than that of said substantially cylindrical hard metal button;

placing a brazing material adjacent said substantially cylindrical hard metal button;

heating said body portion, substantially cylindrical hard metal button, and said brazing material so that the space between the walls of the hole and the substantially cylindrical hard metal button increases due to the difference in coefficients of thermal expansion of the body portion and the substantially cylindrical hard metal button, respectively, said substantially cylindrical hard metal button moves freely about in said hole and said brazing material melts and flows into and fills said space; and cooling said body portion, substantially cylindrical hard metal button, and the molten brazing material so that during initial cooling said brazing material solidifies and forms a shell between said substantially cylindrical hard metal button and the wall of said hole and during further cooling said hole in said body portion shrinks more than said substantially cylindrical hard metal button so that said body portion compresses said substantially cylindrical hard metal button through the solidified brazing material, the resulting compressive fit of the substantially cylindrical hard metal button in the hole in the body portion resulting essentially only from the above cooling of said substantially cylindrical hard metal button, brazing material, and body portion.

2. The method according to claim 1 wherein said step of positioning said substantially cylindrical hard metal button comprises applying a force to place said substantially cylindrical hard metal button into said hole due to a close fit between said hole and said substantially cylindrical hard metal button.

3. The method according to claim 3, wherein said step of placing said brazing material comprises placing said brazing material annularly around said substantially cylindrical hard metal button so that said brazing material remains substantially outside said hole.

4. The method according to claim 1, wherein said step of placing said brazing material comprises placing said brazing material around said substantially cylindrical hard metal button outside said body portion, said brazing material being a ring having an inside diameter that is approximately equal to an outside diameter of said hard metal button.

5. The method according to claim 1, wherein said step of placing said brazing material comprises placing said brazing material in a groove at an upper edge of said hole.

6. The method according to claim 1, wherein said step of placing said brazing material comprises placing said brazing material in the bottom of said hole under said substantially cylindrical hard metal button.

7. The method according to claim 1, wherein said brazing material prior to the above heating is annular in shape with an inside diameter substantially equal to the diameter of the hard metal button.

8. The method according to claim 1, wherein said brazing material prior to the above heating is an annular brazing ring which is broken along part of a periphery of the ring so that the diameter of the brazing ring expands to fit around said substantially cylindrical hard metal button.

9. The method according to claim 1, wherein said substantially cylindrical hard metal button is a plurality of substantially cylindrical hard metal buttons in a plurality of holes in the body portion.

* * * * *